US007819540B2

(12) United States Patent
Desmet et al.

(10) Patent No.: US 7,819,540 B2
(45) Date of Patent: Oct. 26, 2010

(54) CONTROL DEVICE FOR AN APPLIANCE

(75) Inventors: James Desmet, Louisville, KY (US); Daniel Joseph Trice, Louisville, KY (US); Julia Fonseca, Louisville, KY (US); H. Richard Bowles, Louisville, KY (US)

(73) Assignee: General Electric Company, Schenectady, NY (US)

( * ) Notice: Subject to any disclaimer, the term of this patent is extended or adjusted under 35 U.S.C. 154(b) by 92 days.

(21) Appl. No.: 12/128,536

(22) Filed: May 28, 2008

(65) Prior Publication Data

US 2009/0296371 A1 Dec. 3, 2009

(51) Int. Cl.
*F21V 33/00* (2006.01)

(52) U.S. Cl. ..... 362/85; 362/23; 362/92

(58) Field of Classification Search ..... 362/29, 362/85, 92, 23
See application file for complete search history.

(56) References Cited

U.S. PATENT DOCUMENTS 2,545,508 A * 3/1951 Allen ..... 340/815.47
3,318,280 A * 5/1967 Hodgson ..... 116/310
4,360,739 A * 11/1982 Goldstein ..... 307/132 E
4,930,048 A * 5/1990 Ito ..... 362/26
5,464,955 A 11/1995 Cole
6,145,998 A * 11/2000 Lynch et al. ..... 362/85
7,500,759 B2 * 3/2009 Lin ..... 362/33
2006/0203462 A1 9/2006 Stacey

FOREIGN PATENT DOCUMENTS

DE 19819433 C1 9/1999
GB 970712 A 11/1960
GB 2151404 A 7/1985

OTHER PUBLICATIONS

Lynx Professional Grills Brochure, Feb. 2007.

* cited by examiner

*Primary Examiner*—John A Ward
(74) *Attorney, Agent, or Firm*—Global Patent Operation; Douglas D. Zhang

(57) ABSTRACT

A control device for a household appliance is disclosed. The control device includes a control panel having a front panel and a panel lip extending outward from the front panel; a plurality of controls for selectively controlling operation of the appliance, the controls being disposed on the front panel; and a plurality of lighting devices supported by the panel lip for illuminating the respective controls. A household appliance such as a gas range incorporating the control device is also disclosed.

15 Claims, 6 Drawing Sheets

CONTROL DEVICE FOR AN APPLIANCE

BACKGROUND OF THE INVENTION

The present invention relates generally to a control device for an appliance. More particularly, the present invention relates to a control device for a household appliance and a household appliance incorporating such a control device.

A household appliance normally has various controls so that an operator can selectively control the operation of the appliance. Some types of household appliances, such as washers or dryers, typically do not have any integral lighting devices for illuminating the controls. Moreover, these types of household appliances are often located in low-light areas such as utility rooms, basements, and/or under objects such as cabinets. Low-light conditions can make it difficult to read the controls and/or to set the controls properly. If a household appliance is not set properly due to low-light conditions, it may not perform as expected by the operator or it may run longer than necessary and therefore waste energy.

Some types of household appliances often have integral lighting devices for illuminating at least some of the controls. Ranges are a good example. A typical, mainstream range often has burner controls on a front panel of the range and oven controls on a back panel of the range. Since the range is often placed in a kitchen and under a top object such as a vent hood or a cabinet that often blocks some of light from the kitchen light, the back panel typically has a single integral lighting device for illuminating all of the oven controls. However, in today's high-end ranges, the trend is to eliminate the back panel and to place all of the controls on the front panel of the ranges without employing any integral lighting device for illuminating the controls. Needless to say, low-light conditions, such as when the kitchen light is turned off, can make it difficult to read the controls and/or to properly set the controls of such ranges.

It is therefore desirable to incorporate lighting devices into household appliances for the purposes of illuminating the controls of the appliances. In the past, various attempts have been made to provide a control device for an appliance, which has integral lighting devices for illuminating the respective controls. Although these control devices may operate with some degrees of success, they often have various disadvantages. For example, the integral lighting devices often have a complicated structure and/or components. In addition, when each control has its own, exclusive lighting device, typically light is not used to illuminate the control directly. Furthermore, once each lighting device is installed in the appliance, it is often difficult to reach, repair or replace it.

SUMMARY OF THE INVENTION

As described herein, the preferred embodiments of the present invention overcome one or more of the above or other disadvantages known in the art.

One aspect of the present invention relates to a control device for an appliance. The control device includes a control panel having a front panel and a panel lip extending outward from the front panel; a plurality of controls for selectively controlling operation of the appliance, the controls being disposed on the front panel; and a plurality of lighting devices supported by the panel lip for illuminating the respective controls.

Another aspect of the present invention relates to a household appliance such as a gas range that incorporates the inventive control device. More specifically, the appliance includes a control panel having a front panel and a panel lip extending outward from an upper edge of the front panel, the panel lip having a downward facing surface having a plurality of openings; a plurality of controls for controlling operation of the household appliance, the controls being disposed on the front panel and below the respective openings of the panel lip; and a plurality of lighting devices disposed inside of the panel lip for illuminating the respective controls.

These and other aspects and advantages of the preferred embodiments of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE PREFERRED EMBODIMENTS OF THE INVENTION

Figure 1:
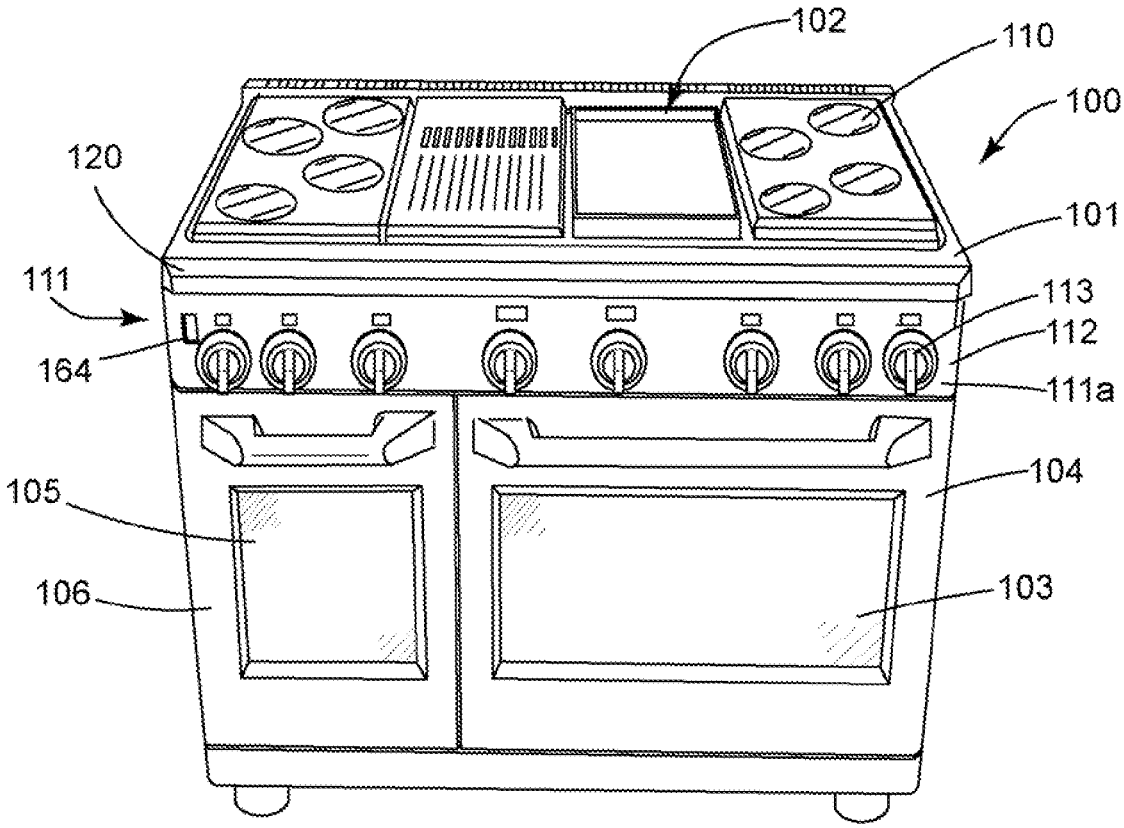
FIG. 1 is a perspective view of an exemplary gas range incorporating a preferred embodiment of the control device of the present invention.

An exemplary household appliance incorporating a preferred embodiment of the control device of the present invention is generally designated by reference numeral 100 in FIG. 1. By way of example, the household appliance is shown as a freestanding gas range in FIG. 1. However, the preferred embodiments of the control device of the present invention can also be used in other types of household appliances such as electric ranges, washers or dryers.

The gas range 100 includes an outer body or housing 101 that has a generally rectangular shaped cook top or top surface 102. A main oven 103 is positioned below the cook top 102 and has a first front-opening access door 104. Optically, a smaller, companion oven 105 is positioned adjacent to the main oven 103 and below the cook top 102. The companion oven 105 has a second front-opening access door 106. The gas range 100 also includes a plurality of heating elements such as burners 110 positioned or arranged on the cook top 102 as well as heating elements in the ovens 103, 105.

A range control device 111 is positioned above the access doors 104, 106. As illustrated in FIG. 1, the control device 111 includes a control panel 111*a* having a front panel 112. The control panel 111*a* is preferably formed as an integral part of the housing 101. A plurality of controls such as switch knobs 113 are disposed or arranged on the front panel 112.

Figure 2:
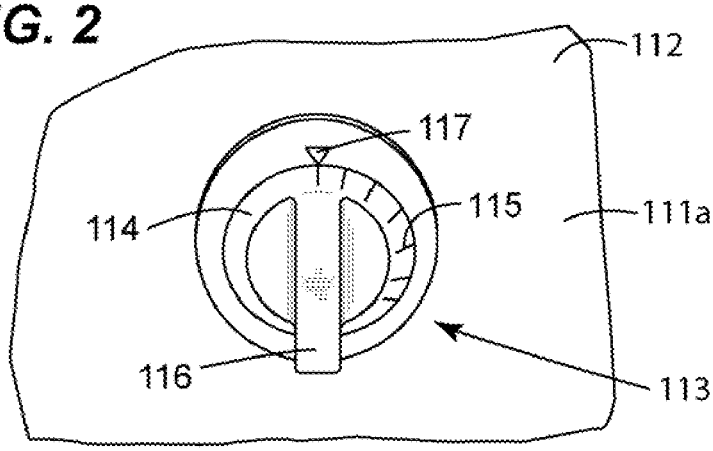
FIG. 2 is an enlarged, front view of a switch knob of FIG. 1.

As is well known in the art, the switch knobs 113 are used to selectively control the operation of the burners 110 and the ovens 103, 105. Additionally, as is well known in the art, each switch knob 113 is rotatable and axially displaceable relative to the front panel 112. As shown in FIG. 2, each switch knob 113 includes a generally truncated conical base 114 with a scale or marking symbols 115 on its peripheral surface, and a generally elongated handle 116 which projects outward from the base 114. The front panel 112 has a corresponding marking symbol such as an arrow 117 on its front surface. Of course, as is known in the art, the scale or marking symbols 115 can be placed on the front surface of the front panel 112 and the arrow 117 can be placed on the front surface of the base 114 instead. The switch knobs 113, the way they are rotatably and axially displaceably supported by the front panel 112, and the way they operate are all well known in the art (see, for example, FIGS. 2A and 2B of U.S. Pat. No. 5,464,955, the entire content of which patent is incorporated herein by reference). Therefore, they will not be discussed in detail here.

Figure 4:
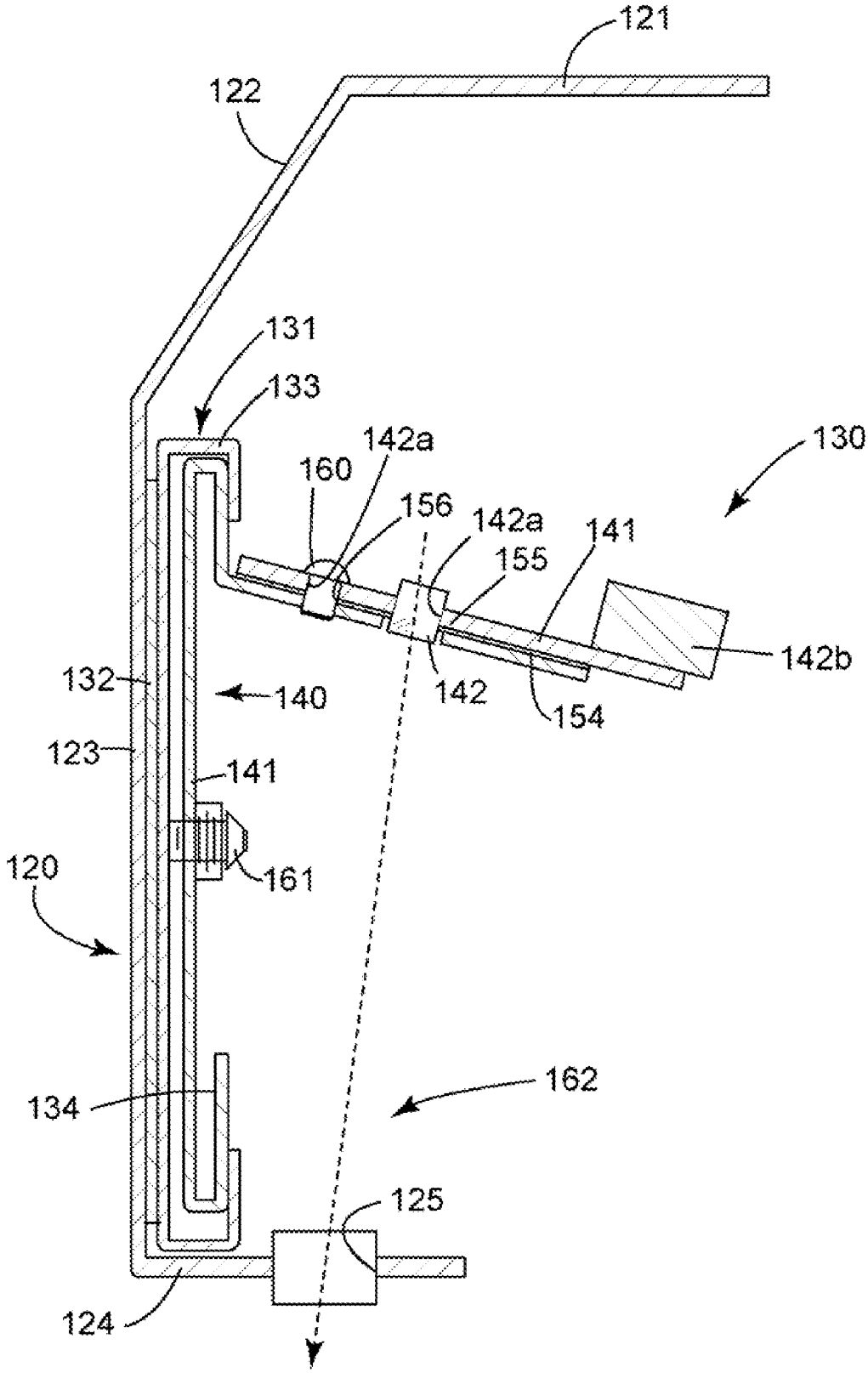
FIG. 4 is an enlarged, cross-section view of the control device of FIG. 1, showing, among other things, a representative lighting device.

As shown in FIG. 1, the control panel 111*a* also has a protruding panel lip 120 (known as bullnose in the art) which is attached to the upper edge of the front panel 112 and extends outward therefrom. As best illustrated in FIG. 4, the panel lip 120 has a substantially horizontally disposed, upward facing top surface 121 which is preferably made integral with the cook top 102. The panel lip 120 also has an oblique upper front surface 122 which extends outward and downward from the outer edge of the top surface 121, and a substantially vertically disposed lower front surface 123 which extends downward from the lower edge of the upper front surface 122. The panel lip 120 also has a substantially horizontally disposed, downward facing bottom surface 124 which extends inward from the bottom edge of the lower front surface 123. Preferably, the top surface 121, the oblique upper front surface 122, the lower front surface 123, and the bottom surface 124 are formed as a one-piece element.

Figure 3:
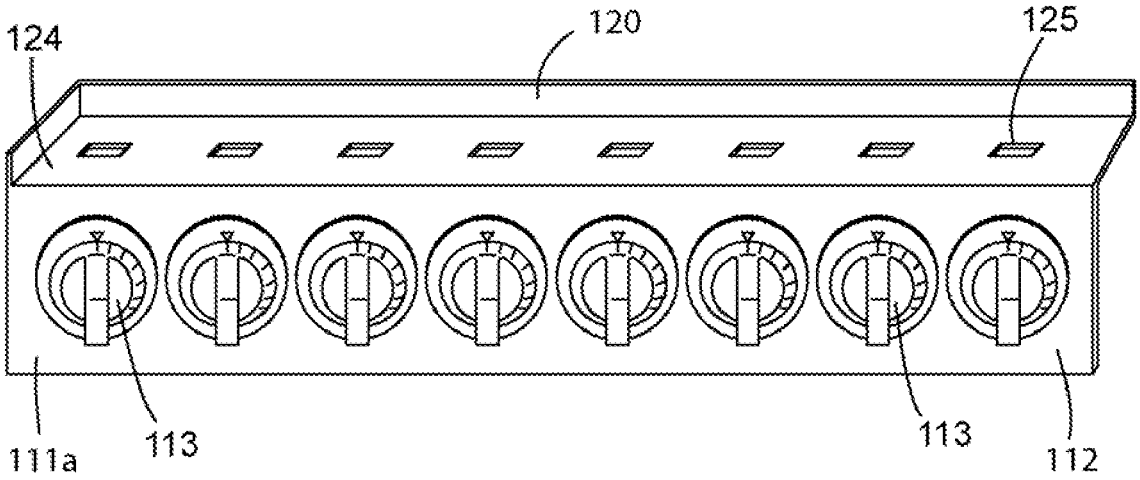
FIG. 3 is a schematic, perspective view of the control panel of the control device of FIG. 1.

As shown in FIGS. 3 and 4, the bottom surface 124 of the panel lip 120 has a plurality of openings or slots 125 which are disposed above, and preferably substantially aligned with the respective switch knobs 113. The function of the openings 125 will be discussed below.

Figure 7:
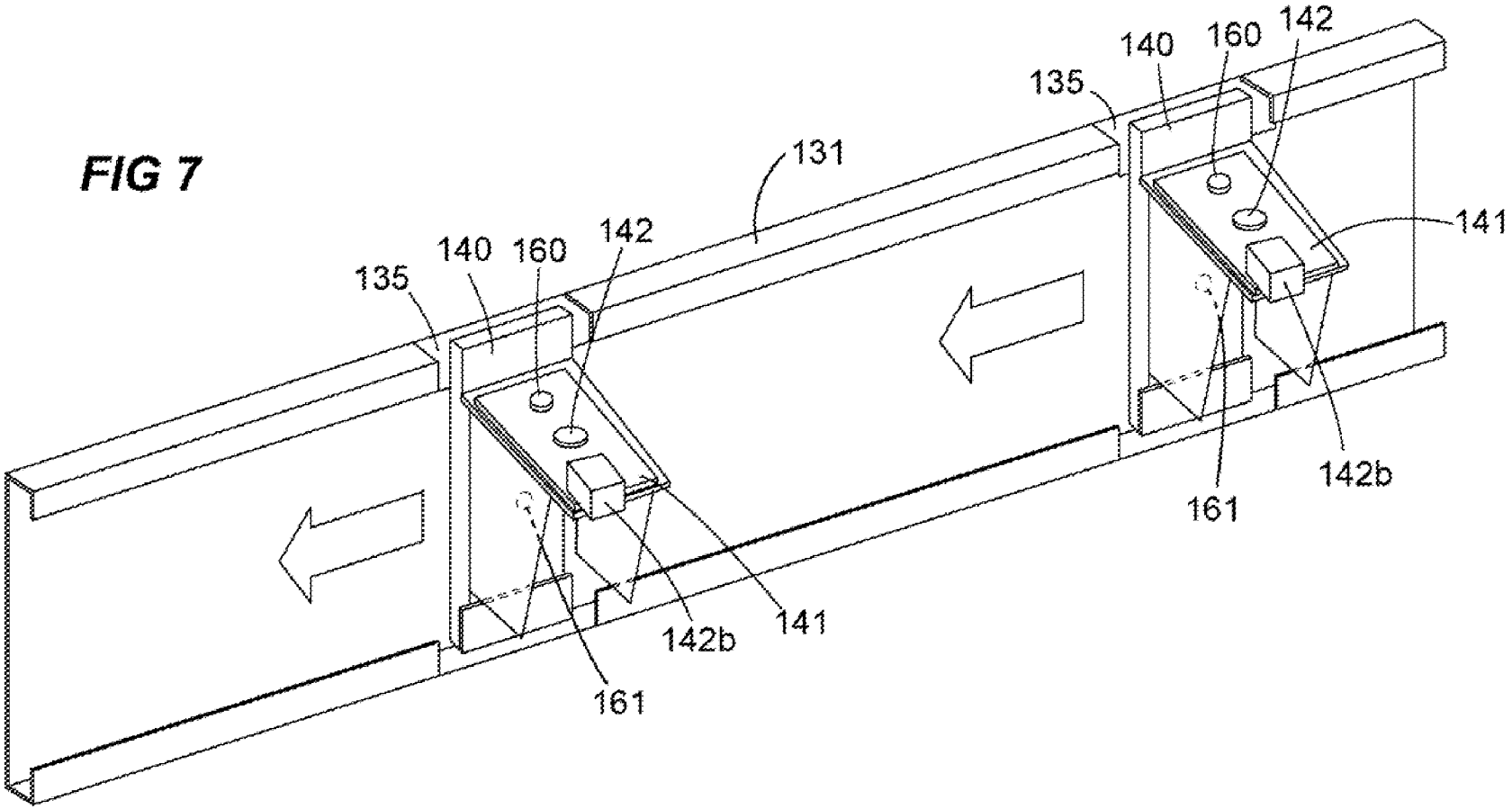
FIGS. 7 and 8 illustrate how each lighting device is assembled.
Figure 8:
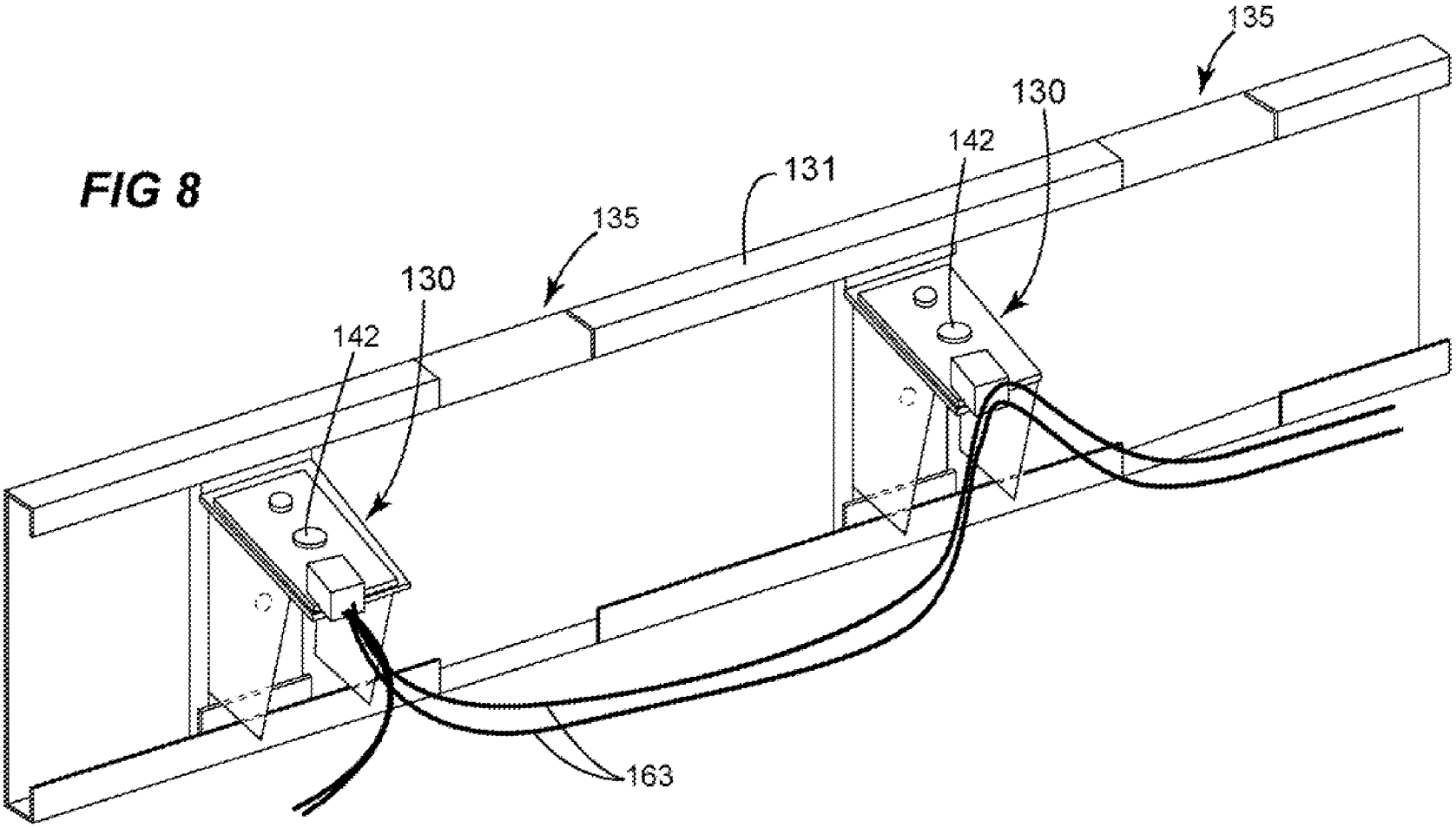

Referring now to FIG. 4, disposed inside of and supported by the panel lip 120 are a plurality of lighting devices 130. A support member or rail member 131 is releasably attached to the lower front surface 123 of the panel lip 120 by fasteners such as an adhesive tape 132. The support member 131 has an upper bent portion 133 and a lower bent portion 134. As illustrated in FIGS. 7 and 8, preferably the lighting devices 130 share a common support member 131. Moreover, preferably parts of the upper bent portion 133 and the lower bent portion 134 of the support member 131 are removed to form gates 135. The function of the gates 135 will be discussed below.

Figure 6:
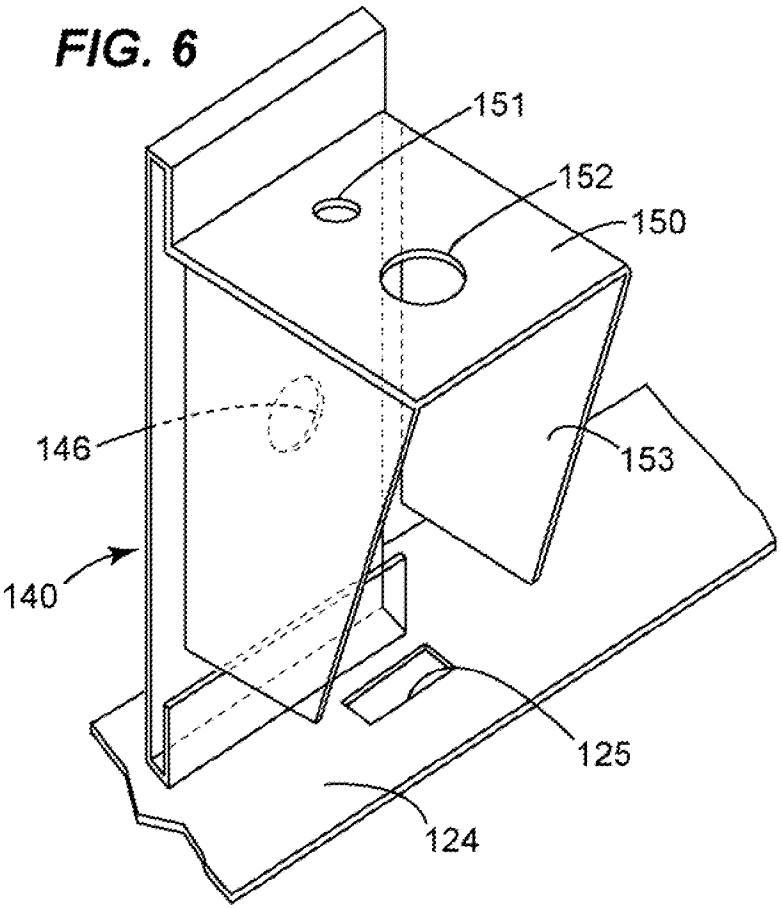
FIG. 6 is a schematic, perspective view of the mounting member of the lighting device of FIG. 4, shown with part of a panel lip of the control panel.
Figure 5:
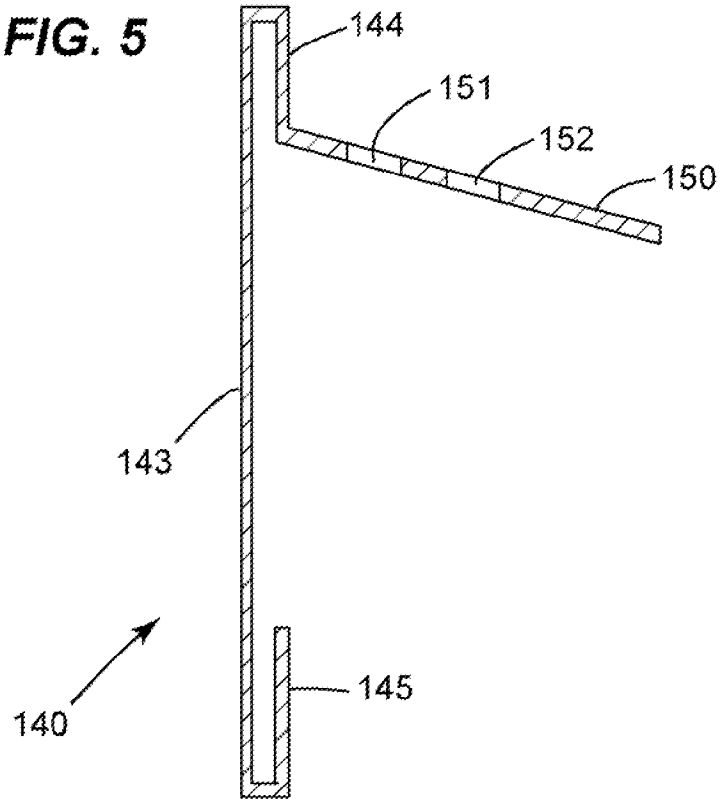
FIG. 5 is a schematic, cross section view of a mounting member of the lighting device of FIG. 4.

As shown in FIGS. 4-6, each lighting device 130 includes a mounting member 140 which is releasably attached to the support member 131, and a carrying member 141 which is releasably supported by the mounting member 140. The carrying member 141 has a lighting source such as a light emitting diode (LED) 142 projecting and facing downward, a fastener pass-through hole 142*a*, and a connector such as a two-pin connector 142*b* for the LED 142. Preferably the carrying member 141 is made of a thermally conducting material. More specifically, each mounting member 140 includes a substantially elongated first portion 143. The first portion 143 has an upper bent portion 144, a lower bent portion 145, and a hole such as a threaded hole 146. As shown in FIG. 4, the first portion 143 is configured so that the first portion 143 is received by, and is slidable or displaceable along the support member 131.

As shown in FIGS. 5 and 6, extending outward and downward from the lower edge of the upper bent portion 144 is a second portion 150. The second portion 150 has a hole such as a threaded hole 151, a light pass-through hole 152, and preferably a pair of thermally conducting side wings 153. In order to increase the strength of the lighting device and to eliminate any possible motion-inducing noises, each side wing 153 is preferably attached to the first portion 143 by, for example, a snap connection or welding.

Each lighting device 130 is assembled and installed as follows. First, an electrically insulating and thermally conducting member 154 is placed on the second portion 150 of the mounting member 140. The electrically insulating and thermally conducting member 154 has a corresponding light pass-through hole 155 and preferably a corresponding fastener pass-through hole 156. Then the carrying member 141 is placed on the electrically insulating and thermally conducting member 154 with the LED 142 being substantially aligned with and disposed in the aligned light pass-through holes 155 and/or 152 and the fastener pass-through hole 142*a* being substantially aligned with the fastener pass-through hole 156 and the threaded hole 151. The carrying member 141 is then releasably attached or affixed to the second portion 150 of the mounting member 140 by an electrically non-conductive or electrically isolated fastener such as a screw 160 (electrically isolated means the screw 160 is not in contact with anything electrical). By this configuration, any heat generated by the LED 142 can be easily dispatched to the side wings 153 which function as heat sinks for the LED 142.

Then, as illustrated in FIGS. 7 and 8, the first portion 143 of the mounting member 141 is introduced into the support member 131 through one of the gates 135 and is slid into a predetermined position where the first portion 143 is releasably attached to the support member 131 by a fastener such as, for example, a friction screw 161. The friction screw 161 creates enough clamping force between the upper bent portions 133, 144, and between the lower bent portions 134, 145 so that the mounting member 140 is securely held in place relative to the support member 131 by the clamping force. In the predetermined position, the side wings 153 are disposed on the respective sides of a respective opening 125, and the LED 142 is preferably substantially aligned with the respective opening 125 so that light emitted from the LED 142 can pass through the respective opening 125 for illuminating a respective switch knob 113 positioned below. In this configuration, the mounting member 141 and part of the bottom surface 124 of the panel lip 120 defining the respective opening 125 define or form an air passageway which leads to or is in fluid communication with at least one of the burners 110 (see FIG. 6).

Next, the two-pin connectors 142*b* are electrically connected to a source of electricity by connecting wires 163. A control 164 (see FIG. 1), such as a switch, a dial or a slide, is preferably arranged on the front panel 112 for turning on or off and/or for adjusting the lighting output of the lighting devices 130.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A control device for an appliance, comprising:

a control panel comprising a front panel and a panel lip extending forward from the front panel, the panel lip comprising a surface having a plurality of openings;

a plurality of controls for selectively controlling operation of the appliance, the controls being disposed on the front panel;

a support member disposed inside and supported by the panel lip; and a plurality of lighting devices supported by the support member for illuminating the respective controls through the respective openings, wherein each lighting device comprises a mounting member attached to the support member, and a carrying member supported by the mounting member and carrying a lighting source, the mounting member having a light pass-through hole to expose the lighting source, and wherein the mounting member comprises a first portion received in the support member, and a second portion extending outward from the first portion and having the light pass-through hole and a thermally conducting side wing, said each lighting device further comprising an electrically insulating and thermally conducting member which is disposed between the second portion and the carrying member so that the side wing functions as a heat sink for the lighting source.

2. The control device of claim 1, wherein the panel lip extends outward from an upper edge of the front panel and the surface faces downward so that the openings are disposed above the respective controls.

3. The control device of claim 2, wherein the openings are substantially aligned with the respective controls.

4. The control device of claim 1, wherein the support member is releasably attached to the panel lip.

5. The control device of claim 1, wherein the mounting member is releasably attached to the support member.

6. The control device of claim 1, wherein the carrying member is releasably attached to the mounting member.

7. The control device of claim 1, wherein the lighting source comprises a light emitting diode (LED).

8. The control device of claim 1, wherein the side wing is attached to the first portion.

9. The control device of claim 1, wherein the carrying member is attached to the second portion by an electrically isolated fastener.

10. The control device of claim 1, wherein the appliance is a cooking range.

11. A control device for a gas range comprising at least one burner for surface cooking, the control device comprising:

a control panel comprising a front panel and a panel lip extending forward from the front panel, the panel lip comprising a surface having a plurality of openings;

a plurality of controls for selectively controlling operation of the appliance, the controls being disposed on the front panel;

a support member disposed inside and supported by the panel lip; and a plurality of lighting devices supported by the support member for illuminating the respective controls through the respective openings, wherein each lighting device comprises a mounting member attached to the support member, and a carrying member supported by the mounting member and carrying a lighting source, the mounting member having a light pass-through hole to expose the lighting source, and wherein the mounting member comprises a first portion received in the support member, and a second portion extending outward from the first portion and having the light pass-through hole and two thermally conducting side wings, said each lighting device further comprising an electrically insulating and thermally conducting member which is disposed between the second portion and the carrying member so that each side wing functions as a heat sink for the lighting source, the mounting member and part of the panel lip having the respective opening defining an air passageway for the at least one burner.

12. The control device of claim 11, wherein each side wing is attached to the first portion.

13. The control device of claim 11, wherein the carrying member is attached to the second portion by an electrically isolated fastener.

14. A household appliance comprising:

a control panel comprising a front panel and a panel lip extending forward from an upper edge of the front panel, the panel lip comprising a downward facing surface having a plurality of openings;

a plurality of controls for selectively controlling operation of the household appliance, the controls being disposed on the front panel and below the respective openings of the panel lip;

a support member disposed inside and supported by the panel lip; and a plurality of lighting devices disposed inside of the panel lip for illuminating the respective controls through the respective openings, wherein each lighting device comprises a mounting member attached to the support member, and a carrying member supported by the mounting member and carrying a lighting source, the mounting member having a light pass-through hole to expose the lighting source, and wherein the mounting member comprises a first portion received in the support member, and a second portion extending outward from the first portion and having the light pass-through hole and a thermally conducting side wing, said each lighting device further comprising an electrically insulating and thermally conducting member which is disposed between the second portion and the carrying member so that the side wing functions as a heat sink for the lighting source.

15. The household appliance of claim 14, wherein the openings are substantially aligned with the respective controls.

* * * * *